US006824365B2

(12) United States Patent
Park et al.

(10) Patent No.: US 6,824,365 B2
(45) Date of Patent: Nov. 30, 2004

(54) DISCHARGE APPARATUS FOR RECIPROCATING COMPRESSOR

(75) Inventors: Jung-Sik Park, Seoul (KR); Hyuk Lee, Goyang (KR); Seong-Yeol Hyeon, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/297,753

(22) PCT Filed: May 24, 2001

(86) PCT No.: PCT/KR01/00864

§ 371 (c)(1),
(2), (4) Date: Dec. 9, 2002

(87) PCT Pub. No.: WO02/095231

PCT Pub. Date: Nov. 28, 2002

(65) Prior Publication Data

US 2003/0133816 A1 Jul. 17, 2003

(51) Int. Cl.[7] ..... F04B 39/00; F04B 11/00

(52) U.S. Cl. ..... 417/312; 417/540; 417/417; 181/403

(58) Field of Search ..... 417/363, 417, 417/415, 416, 212, 214, 540, 542, 543, 545, 523, 547, 552, 551, 569, 312, 423.14; 62/6; 310/12; 917/540, 312; 181/403

(56) References Cited

U.S. PATENT DOCUMENTS 4,632,645 A 12/1986 Kawakami et al. ..... 417/417
4,842,492 A * 6/1989 Gannaway ..... 417/312
4,978,285 A * 12/1990 Da Costa ..... 417/569
5,203,857 A * 4/1993 Terwilliger et al. ..... 417/552
5,938,411 A * 8/1999 Seo ..... 417/312
6,328,544 B1 * 12/2001 Kawahara et al. ..... 417/416

FOREIGN PATENT DOCUMENTS

DE 2414961 A1 10/1975 ..... F04B/35/04
JP 11-22642 A 1/1999 ..... B22D/11/10

* cited by examiner

*Primary Examiner*—Charles G. Freay
(74) *Attorney, Agent, or Firm*—Birch, Stewart, Kolasch & Birch, LLP

(57) ABSTRACT

A discharge apparatus for a reciprocating compressor. The compressor includes a shell connected to a gas suction conduit for sucking gas, a cylinder in the shell, a compression unit including a piston performing reciprocal movement in the cylinder, a reciprocating motor having an inner stator, an outer stator, and a armature performing reciprocal movement between them, and a frame unit for supporting the compression unit and the reciprocating motor by connecting them. The discharge apparatus includes a first cover member in which a valve body controlling the discharge of compressed gas by switching the cylinder in contained and at least a gas passage is formed, and a second cover member arranged continuously with the first cover member and connected to the gas discharge hole. In this way, the gas compressed by linear reciprocal movement of the piston in the cylinder is discharged smoothly so the reliability of the compressor operation is improved.

20 Claims, 8 Drawing Sheets

DISCHARGE APPARATUS FOR RECIPROCATING COMPRESSOR

This application is the national phase under 35 U.S.C. 0 371 of PCT International Application No. PCT/KR01/00864 which has an International filing date of May 24, 2001, which designated the United States of America.

1. Technical Field

The present invention relates to a discharge apparatus of a reciprocating compressor, and particularly, a discharge apparatus of a reciprocating compressor, which is capable of attenuating noise of a compression pulse of a refrigerant discharged gas and operation of a hole compressor by designing a form of a cover member.

2. Background Art

In general, a discharge apparatus of a reciprocating compressor is constructed such that a piston of the compressor is integrally combined with the armature of a reciprocating motor and the piston, performing reciprocal movement in a cylinder rectilinearly, sucks gas and then discharges the gas compressed in the direction of the movement of the piston. FIG. 1 is a transverse cross-sectional view of the discharge apparatus of the reciprocating compressor.

As shown in FIG. 1, the discharge apparatus of a reciprocating compressor in accordance with the conventional art, includes a discharge cover 11 installed fixed having a certain discharge space Q on the front end surface of the reciprocating cylinder 2 and the piston 1 inserted to the apparatus and integrally combined with the armature of the reciprocating motor, a discharge valve 12 made of plastic and installed inside the discharge cover 11 for controlling discharge of compressive gas by switching (opening/closing) the cylinder 2 removed from the front end surface of the cylinder when the piston 1 performs reciprocal movement, and a valve spring 13 wherein the end is fixed on the inner wall of the discharge cover and the other end fixing the upper end for supporting the reciprocal movement of the discharge valve by the reciprocal movement of the piston 1 elastically having a form of a coil spring.

The discharge pipe 14 connected to the loop pipe (not shown) installed on an end of the discharge cover 11, and the flange unit 11*a* is formed in the widely opened part.

The diameter of the discharge valve 12 is formed bigger than the inner diameter of the cylinder 2 and smaller than the inner diameter of the discharge cover 11. The inner end surface opposite to the piston 1 is flat, and on the other hand, the outside end surface opposite to the discharge cover 11 is formed to be convex as a dome shape to be abutted to the cylindrical valve spring.

Reference numeral 1*a* designates a refrigerant channel, reference numeral 3 designates a suction valve, reference letter P designates a compression space, and reference letter Q designates a discharge space.

The above-described conventional discharge apparatus of a reciprocating compressor is operated as follows.

As shown in FIGS. 2 and 3, if the piston 1 formed integrally performs reciprocal movement with the armature of a reciprocating motor inside the cylinder 2, the refrigerant gas is sucked into the compression space P of the cylinder 2 through the refrigerant channel 1*a* formed inside the piston 1 and discharged out through the discharge space Q of the discharge cover 11 repeatedly.

Namely, if the piston 1 is on the suction stroke, a new refrigerant gas flows into the compression space P through the refrigerant channel 1*a* opening the suction valve 3 installed on the front end surface.

The refrigerant gas flowed in the compression space P is pushed and compressed during the compression stroke of the piston 1, and from a certain moment, the refrigerant gas pushes the discharge valve 12.

The compression gas filled in the discharge space Q is pushed by the discharge valve 12 and discharged out through the discharge pipe 14.

At the same time, the refrigerant gas compressed in the compression space P flows into the discharge space Q through the gap between the discharge valve 12 and the discharge cover 11.

Then, during the suction stroke of the piston 1, the pressure is relatively lower in the compression space P than in discharge space Q and the discharge valve 12 is restored, mounted to the front end surface of the cylinder 2, and divides the compression space P and the discharge space Q by the restoring force of the valve spring 13.

However, in the conventional discharge apparatus of the reciprocating compressor above, the compressed gas is discharged to the discharge cover in the process of discharging the compressed refrigerant gas switching the discharge valve repeatedly, and then the pressure pulse in the discharge cover increases. Therefore, noise in the discharge cover increases and the shock noise, generated when the discharge valve 12 is bumped into the front end surface of the cylinder by switching the discharge valve 12, is not able to be diminished sufficiently.

Also, in case of installing the compressor having the discharge apparatus, the loop pipe connected to the discharge apparatus receives pressure pulse, and accordingly, the secondary noise is generated when the refrigerator itself vibrates in response to the increased vibration level.

SUMMARY OF THE INVENTION

Therefore, it is an object of the present invention to provide a discharge apparatus of a reciprocating compressor to attenuate noise resulted from compression pulse in the discharge cover and shock generated when switching the discharge valve, and prevent the vibration level of the loop pipe connected to the discharge cover from rising.

To achieve these objects, there is provided a discharge apparatus of a reciprocating compressor comprising, a shell connected to a gas suction conduit or sucking gas, a cylinder in the shell, a compression unit including a piston performing reciprocal movement in the cylinder, a reciprocating motor having an inner stator, an outer stator, and an armature performing reciprocal movement between them, and a frame unit for supporting the compression unit and the reciprocating motor by connecting them, consist of a first cover member in which a valve body controlling the discharge of compressed gas by switching the cylinder in contained and at least a gas passage is formed, and a second cover member arranged continuously with the first cover member and connected to the gas discharge hole.

DETAILED DESCRIPTION OF THE PREFERRED EMBODIMENTS

Figure 1:
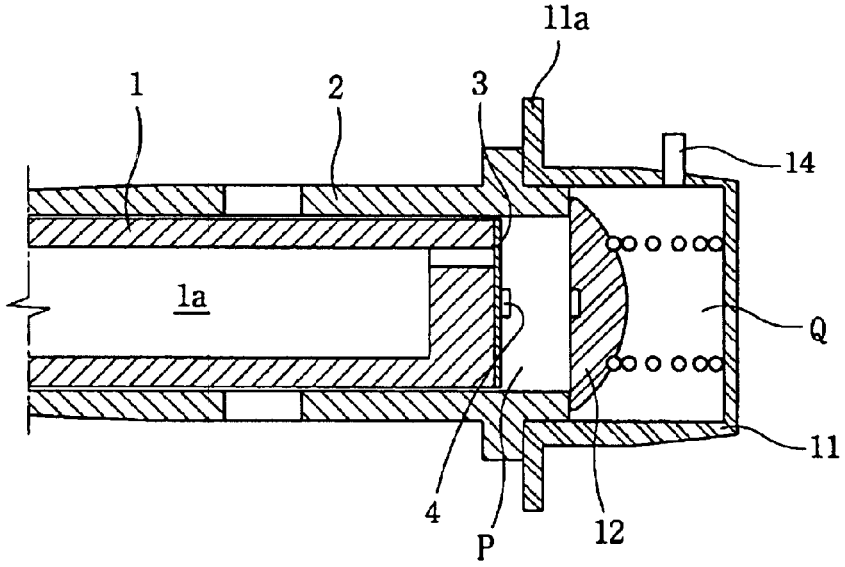
FIG. 1 CONVENTIONAL ART
FIG. 1 is a transverse cross-sectional view showing a discharge apparatus of a reciprocating compressor in accordance with the conventional art.
Figure 2:
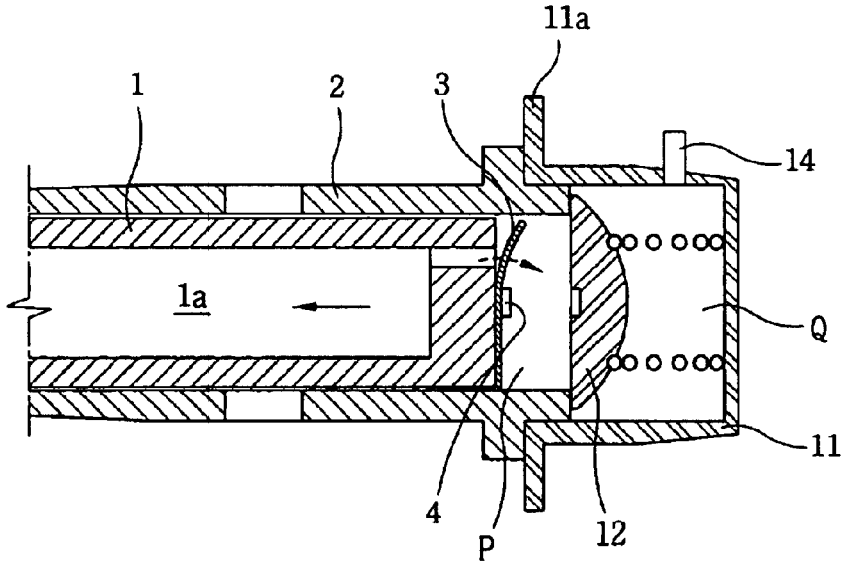
FIG. 2 CONVENTIONAL ART
FIG. 2 is a transverse cross-sectional view showing an operation of the discharge apparatus of a reciprocating compressor in accordance with the conventional art.
Figure 3:
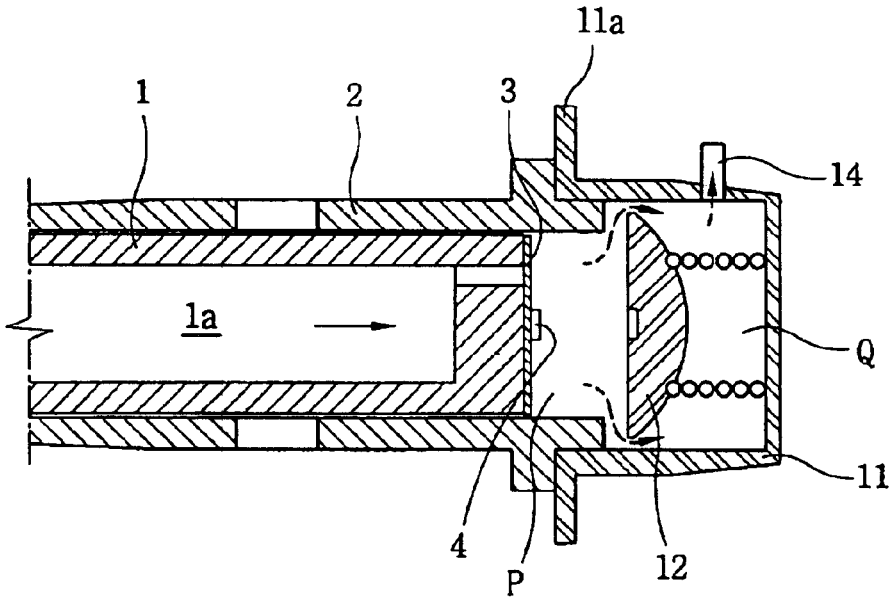
FIG. 3 CONVENTIONAL ART
FIG. 3 is a transverse cross-sectional view showing an operation of the discharge apparatus of a reciprocating compressor in accordance with the conventional art.

The discharge apparatus of a reciprocating compressor according to the present invention will be described with reference to the embodiments in the accompanying drawings.

The same components as those of the conventional art are designated by the same reference numerals, and an explanation of their same operation are omitted.

Hereinafter, the first embodiment of the present invention will be described.

Figure 4:
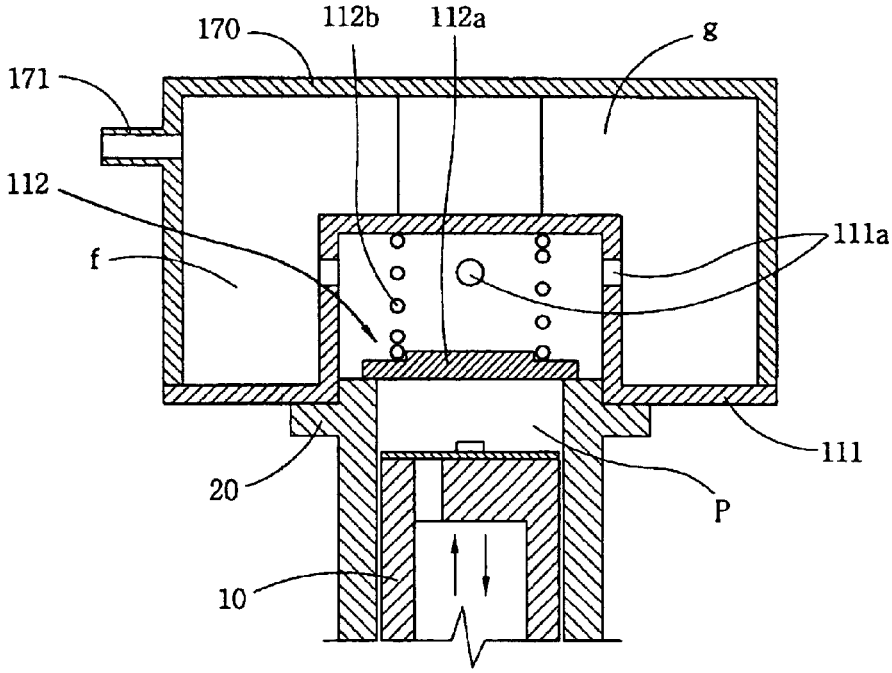
FIG. 4 is a front sectional view showing first embodiment of a discharge apparatus of a reciprocating compressor in accordance with the present invention.

As shown in FIG. 4, the discharge apparatus of a reciprocating compressor according to the present invention includes a reciprocating piston 10 receiving driving force from the vibration apparatus unit, which generates driving force, a compression space P in which gas is compressed by the piston 10 and cylinder 20, and a discharge valve assembly 112, for discharging compressed gas by switching (opening/closing) the compression space P in accordance with the movement of the piston 10 inside the discharge cover 111 to cover the compression space P, and the discharge valve assembly 112 is composed of a discharge valve 112*a* for switching the compression space P and a spring 112*b* for supporting the discharge valve 112*a*.

Also, a multi-plenum cover 170 covering the discharge cover 111 forms discharge spaces with the periphery of the discharge cover 111 covering the discharge cover 111 is combined and a plurality of the gas passages 11*a* are formed through the outside wall of the discharge cover 111 to make the gas discharged to inside the discharge cover 111 flow to the plurality of the buffer spaces f in the multi-plenum cover 170.

The discharge hole 171 for discharging gas flown to the buffer space of the multi-plenum cover 170 is formed in one of the plurality of buffer spaces f.

Also, a plurality of gas passages 111*a* are formed to connect the inner part of the discharge cover 111 and the buffer space f, and it is desirable that the multi-plenum cover 170 has buffer spaces f to be a form of a four-leaf clover.

Figure 5:
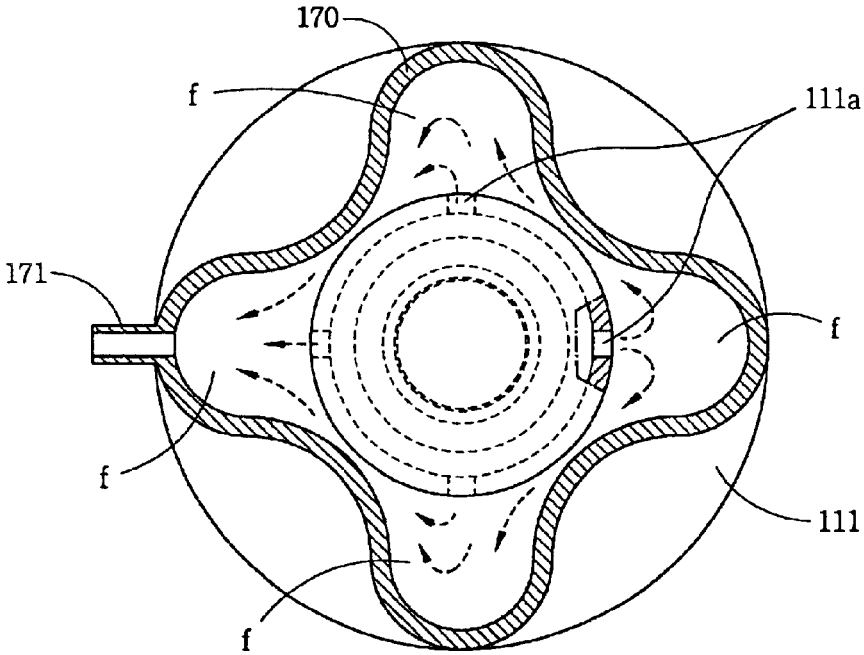
FIG. 5 is a plane view showing a multi-plenum cover composing the first embodiment of a discharge apparatus of a reciprocating compressor in accordance with the present invention.

Namely, as shown in FIG. 5, the outside wall is formed by symmetrically curved portions having a certain thickness, and a space having a form as a cross is formed inside the discharge cover 111, A plurality of buffer spaces are formed by the periphery of the discharge cover 111 and inside of the multi-plenum cover 170.

On the other hand, the inside height of the buffer space f is formed to be higher than that of the discharge cover 111, and accordingly, a joint space g, which each buffer space f is formed to connect the buffer space f and the collateral part between the outside end surface of the discharge cover 111, and the discharge hole 171 is also formed in one of the plurality of the buffer spaces.

Also, the gas passage 111*a* connected with the discharge cover 111 in the upper part of the joint space g can be formed on the upper end additionally to improve efficiency of the compressor by increasing discharge gas.

Figure 14:
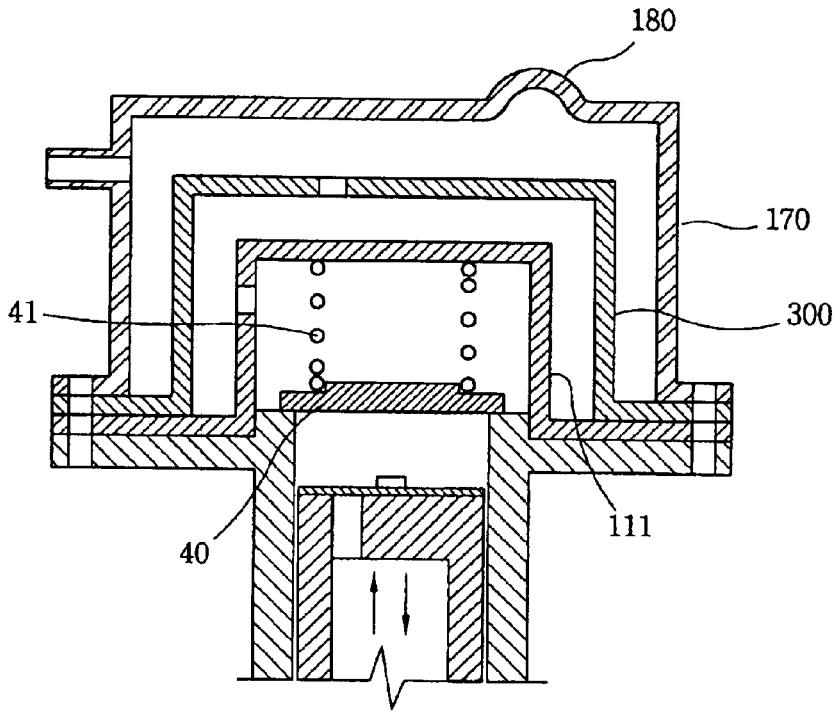
FIG. 14 is a front-sectional view showing the other embodiment of the first embodiment of a discharge apparatus of a reciprocating compressor in accordance with the present invention.

Also, as shown in FIG. 14, another embodiment is possible by combining the central cover 300 between the discharge cover and the multi-plenum cover 170 so that the efficiency of the buffer space f is improved.

At that time, the central cover 300 can be a cover formed as a simple cap or a multi-plenum cover. It is desirable to combine these covers in accordance with the noise characteristics of the discharge apparatus.

Also, the number of the plurality of buffer spaces f can be sequentially increased from, but if the noise characteristics in the range of 2~4 kHz, wherein noise is currently problematic and the examination of the noise characteristics are considered, it is most desirable that 4 buffer spaces f are formed symmetrically.

In addition, the desirable diameter of the discharge hole is less than 5 mm, but for practical embodiments, forming a 2~4 mm diameter is desirable.

Also, on one side of the circumference in the outermost cover of the covers, whether it is the multi-plenum cover or the cover formed as a simple cap, a convex unit 180 is formed and functions as a stopper to prevent the inside wall of the shell and other important parts from bumping into each other during the operation of the reciprocating compressor in accordance with the present invention.

The convex unit 180 is desirable to be located in a part, wherein the crest hump does not interrupt the power connector formed on the circumference.

The discharge cover 111 and the central cover 300 are desirable to be pressed fit and formed integrally, and as an example of the combination, brazing is used.

Hereinafter, the effect of the discharge apparatus of reciprocating compressor in accordance with the present invention will be described as follows.

Figure 6:
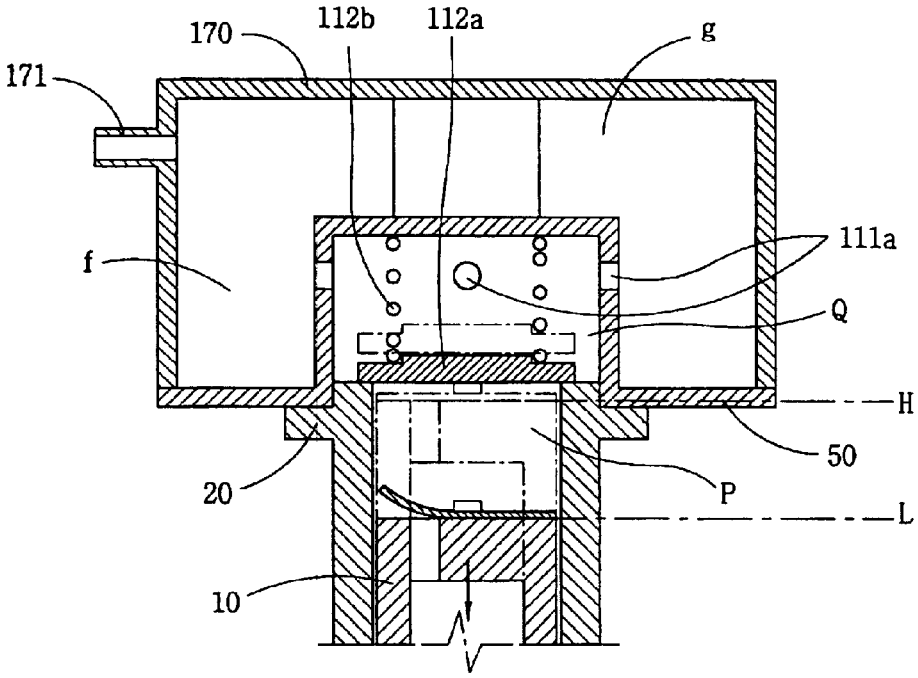
FIG. 6 is a front-sectional view showing an operation status of the first embodiment of a discharge apparatus of a reciprocating compressor in accordance with the present invention.

Firstly, the piston 10, receiving driving force from the electromotive apparatus performs reciprocal movement, and as shown in FIG. 6, the piston 10 moves from the upper dead center H to the low dead center L. Then the discharge valve 112*a*, composing the discharge valve assembly 112, closes up the compression space P of the cylinder at the same time as gas is sucked into the compression space P of the cylinder 20.

Figure 7:
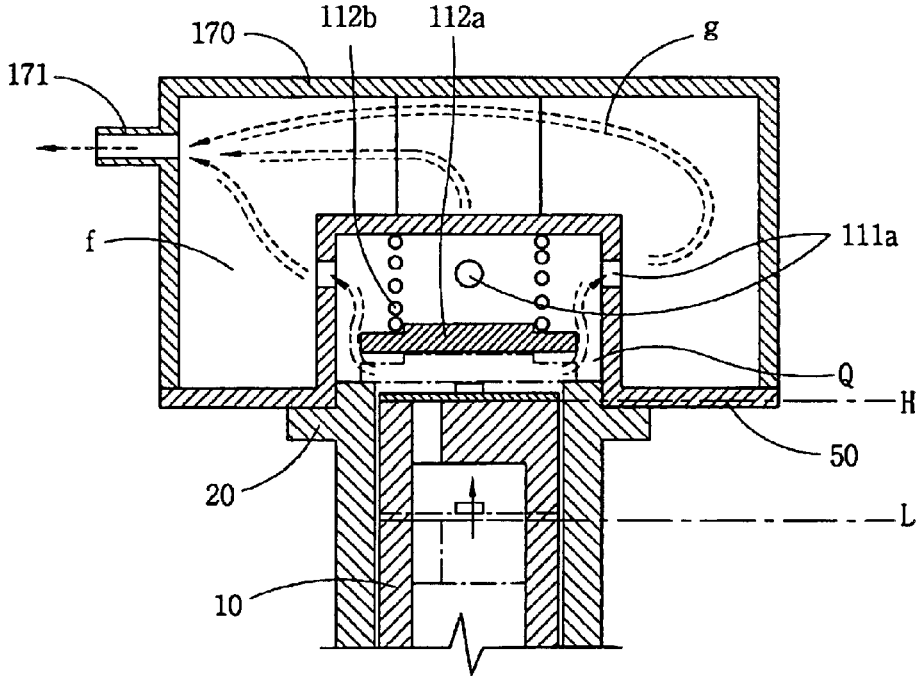
FIG. 7 is a front-sectional view showing an operation status of the first embodiment of a discharge apparatus of a reciprocating compressor in accordance with the present invention.

Then, as shown in the FIG. 7, when the piston 10 moves from the lower dead center L to the upper dead center H, the piston 10 reaches the upper dead center H compressing the gas sucked into the compression space P, and when a certain compression state is achieved, the compressed gas is discharged in response to opening of the discharge valve 112*a* supported by the spring 112*b* elastically.

The process that the compressed gas is discharged in the compression space is as follows. As the discharge valve 112*a* is opened, the compressed gas flown to the discharge space Q in the discharge cover 111 and at the same time, the gas flows in the buffer space f formed by the outside of the discharge cover 111 through the gas passage 111*a* formed in the discharge cover 111 and inside of the multi-plenum cover 710. Then the gas flown to the buffer space g flows into the joint space and respective buffer spaces f through the discharge hole 171, and the gas is discharged out.

Also, as the gas compressed in the compression space P is discharged through the discharge path, the noise of pulses, from the flowing gas generated from inside the discharge cover 111 and the shock noise of valve are minimized.

Namely, by the buffer space f formed by the outside of the discharge cover 111 and the multi-plenum cover 170, the volume of the discharge plenum region is increased 5 times compared with the conventional structure, and as a result, the performance to attenuate the pulses of discharge compression with low frequency is improved. Also, the plurality of buffer spaces offset the compression waves of the generated noise can be removed due to the structure of having a plurality of buffer spaces f remarkably.

In addition, in the present invention the structure of the compressor can be simple and assembly is easy to perform by processing and pressing the discharge cover 111 and the central cover 300.

Hereinafter, the second embodiment of the reciprocating compressor in accordance with the present invention will be described.

Figure 8:
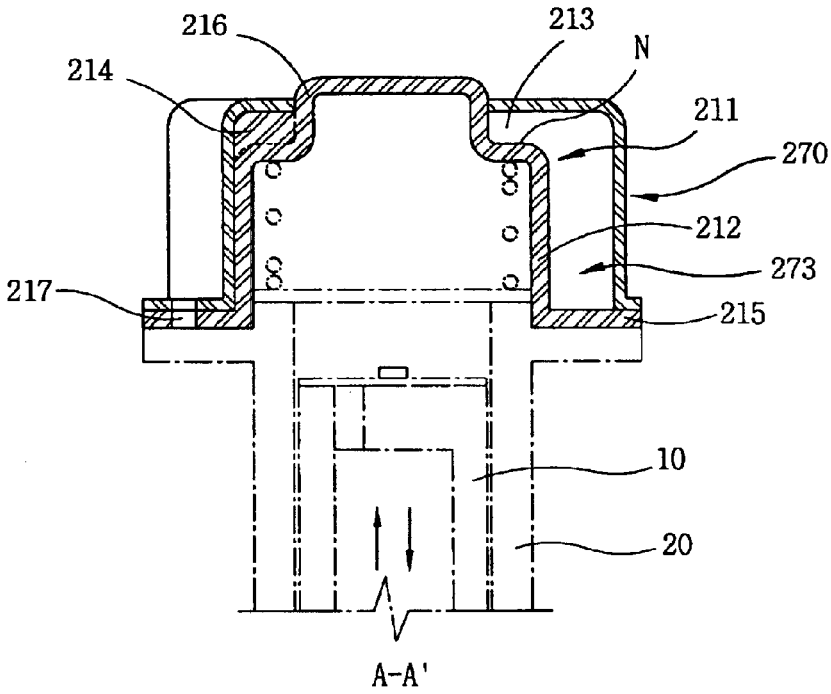
FIG. 8 is a front-sectional view showing a second embodiment of a discharge apparatus of a reciprocating compressor in accordance with the present invention.
Figure 9:
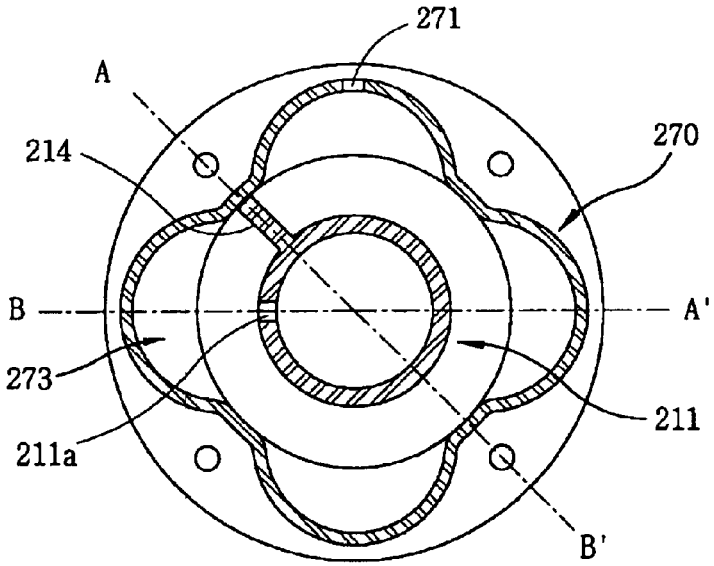
FIG. 9 is a plane cross-sectional view showing a second embodiment of a discharge apparatus of a reciprocating compressor in accordance with the present invention.
Figure 10:
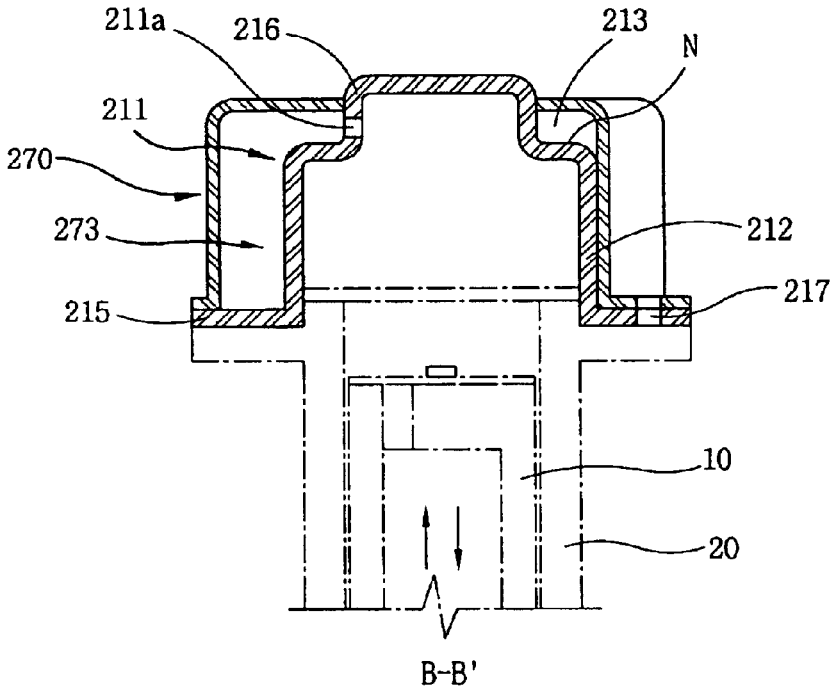
FIG. 10 is a front-sectional view of a showing a second embodiment of a discharge apparatus of a reciprocating compressor in accordance with the present invention.

As shown in FIGS. 8, 9, and 10, the second embodiment of the reciprocating compressor in accordance with the present invention includes a structure as follows. The discharge cover 211, wherein the piston 10 covers the compression space of the reciprocating cylinder 20, has a gas passage 211*a* on the one end, and a plurality of connected buffer spaces 273 inside the piston pressed and combined with the outside of the discharge cover 211 are formed. Also, one of the buffer spaces 273 communicates with a discharge hole 271 to allow refrigerant gas from the gas passage 211*a* to pass sequentially through the plurality of the buffer spaces 273 and out the discharge hole 271.

The discharge cover 211 includes a communication passage 213 formed as an annular groove by the stepped edge in the body unit 212 formed as a cylinder, wherein an end is blocked, a compartment dividing unit 214 for dividing the communication passage 213, a gas passage 211*a* formed near the compartment dividing unit for connecting the inside of the discharge cover 211 and the communication passage 213 and a first coupled parts 215 bent to have a certain area on the edge the body unit 212.

Namely, a cylindrical insertion unit 216 is connected to the body unit 212 of the discharge cover 211 having a smaller periphery than that of the body unit 212 and having a certain height, and as a result, the communication passage 213 is formed between the periphery of the insertion unit 216 and the inside of the multi-plenum cover 270.

The compartment dividing unit 214 divides the communication passage 213 into two portions because it is formed to have a lower height that that of the insertion unit 216 in the stepped surface N composing the communication passage 213 and the same width as the stepped surface N.

The first coupled parts 215 is formed to have a certain area as a flange shape, and an appropriate holes 217 are formed at an opposite portion symmetric to the fist coupled part 215 of the insertion unit 216.

Hereinafter, the structure of the multi-plenum cover 270 will be described in detail.

Figure 11:
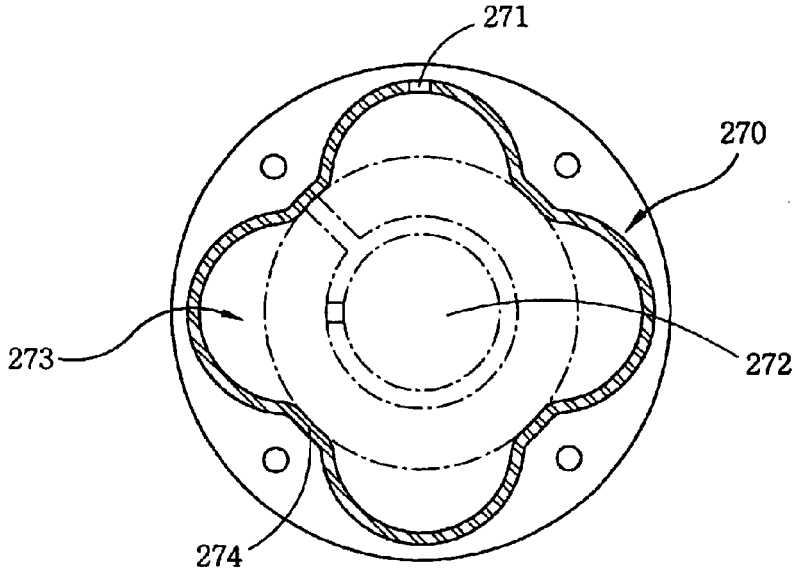
FIG. 11 is a plane cross-sectional showing a multi-plenum cover composing the first embodiment of a discharge apparatus of a reciprocating compressor in accordance with the present invention.
Figure 12:
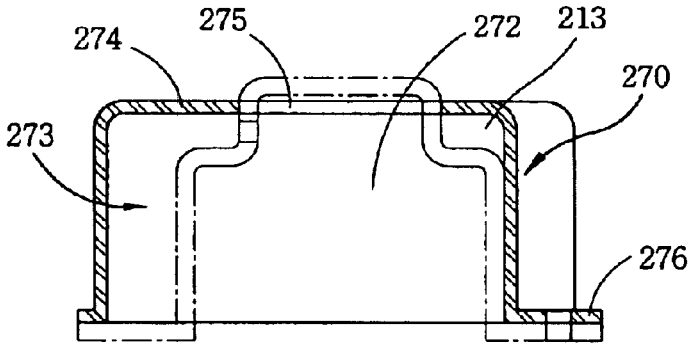
FIG. 12 is a front-sectional view showing multi-plenum cover composing the first embodiment of a discharge apparatus of a reciprocating compressor in accordance with the present invention.

As shown in FIGS. 11 and 12, the multi-plenum cover is formed having the space formation unit 274 to form a plurality of buffer spaces 273 connected side-by-side to the circular insertion space 272 wherein the insertion unit 216 of the discharge cover in the direction of the circumference, an insertion hole penetrated in the space formation unit 274 so that the insertion unit 216 of the discharge cover 211 is protruded in case it bumps into the discharge cover 211 in the space formation unit 274, and the second coupled parts 276 formed to have a certain area on the side of an end of the space formation unit 274.

Also, the buffer space 273 is formed having a certain symmetrical interval, and second coupled parts 275 is desirable to be located in response to the first coupled parts 215.

The inner diameter of the insertion space 272 is formed to have a same outer diameter as that of the body unit 212 of the discharge cover, and the inner diameter of the insertion space 272 is formed to be bigger than that of the insertion unit 216 of the discharge cover 211.

Also, the discharge cover 211 is inserted so that the insertion unit 216 is protruded on the insertion hole 275 of the multi-plenum cover 270. The lower end surface of the multi-plenum cover 270 is abutted to the upper end surface of the compartment asperity unit 214, and the first coupled parts 215 and the second coupled parts 276 are abutted to each other.

At this time, the body part 212 of the discharge cover 216 is located in the insertion space 272 inside the multi-plenum cover 270, and a plurality of buffer spaces 273 are formed by the circumference surface of the insertion unit 216, the body unit 212, the inner upper surface, and the inner circumferential surface of the multi-plenum cover 270, and the plurality of the buffer spaces 273 is connected with each other through the communication passage 213.

The communication channel formed by the communication passage 213 is divided to two parts by the compartment asperity unit 214.

In addition, the discharge hole 271 of the multi-plenum cover 270 is located in the opposite side to the gas passage 211*a* centering around the compartment asperity unit 214.

Figure 15:
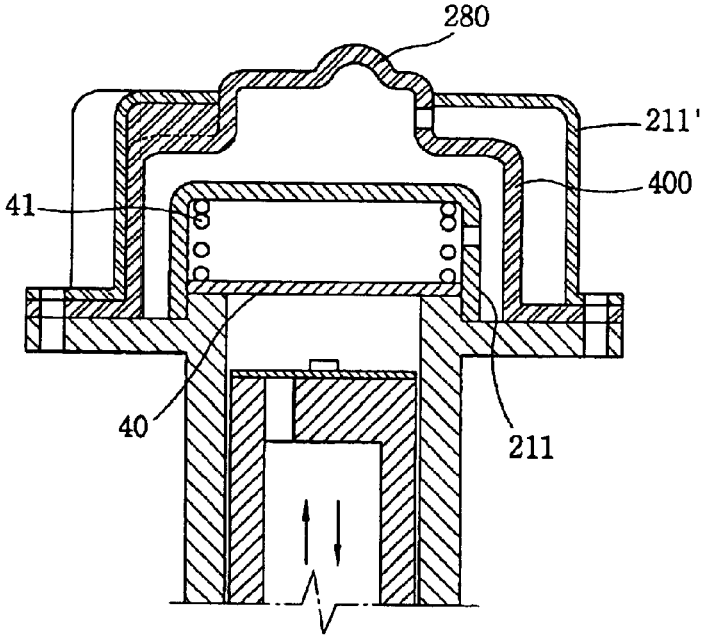
FIG. 15 is a front-sectional view showing the other embodiment of the second embodiment of a discharge apparatus of a reciprocating compressor in accordance with the present invention.

Also, as shown in FIG. 15, another embodiment by combining the central cover 400 having a multi-plenum between the discharge cover 211 and the simple cap cover 270 is possible to operate to improve the effect of the buffer space 273. At this time, the central cover 400 can be either a multi-plenum cover or a simple cap cover, and the covers are desirable to be compounded to use in accordance with the noise characteristic of the discharge apparatus. However, in case of the second embodiment it is desirable to form the central cover 400 as a multi-plenum cover, and the outermost cover as a simple cap cover 211'. On one end of the circumferential surface of the multi-plenum cover protruded out of the outermost cover, a convex unit 280 is formed and functions as a stopper to prevent the inside wall of the shell and another important parts from bumping into each other during the operation of the reciprocating compressor in accordance with the present invention.

Also, the number of the plurality of buffer spaces 273 can be increased from one in order, but if the noise characteristics of the area of 2~4 kHz, wherein noise is currently problematic and the examination of the noise characteristics are considered, it is most desirable that 4 buffer spaces 273 are formed symmetrically.

In addition, the desirable diameter of the discharge hole is less than 5 mm, but for the referred embodiment, forming a 2~4 mm diameter is desirable.

The convex unit 180 is desirable to be located in a part, wherein the convex unit 180 does not interrupt the power connector formed on the circumference.

The discharge cover 211 and the central cover 211' are desirable to be processing as press fit and brazing.

Hereinafter, the assembly of the discharge apparatus of reciprocating compressor in accordance with the present invention will be described.

The discharge cover 211 is combined with the multi-plenum cover 270 covering the compression space P of the cylinder 20, and the piston 10 is inserted enabled to perform reciprocating movement. The piston 10 is connected to the vibration apparatus unit and combines with the discharge valve and the valve spring 112*b* for supporting the discharge valve 112*a* elastically to switch the compression space P of the cylinder 20.

Hereinafter, the effect of the second embodiment of the discharge apparatus of reciprocating compressor in accordance with the present invention will be described.

Firstly, the piston 10, receiving driving force from the vibration apparatus performs reciprocal movement, and the discharge valve 112*a* closes up the compression space P at the same time as gas is sucked to the compression space P, compressed, and discharged.

Figure 13:
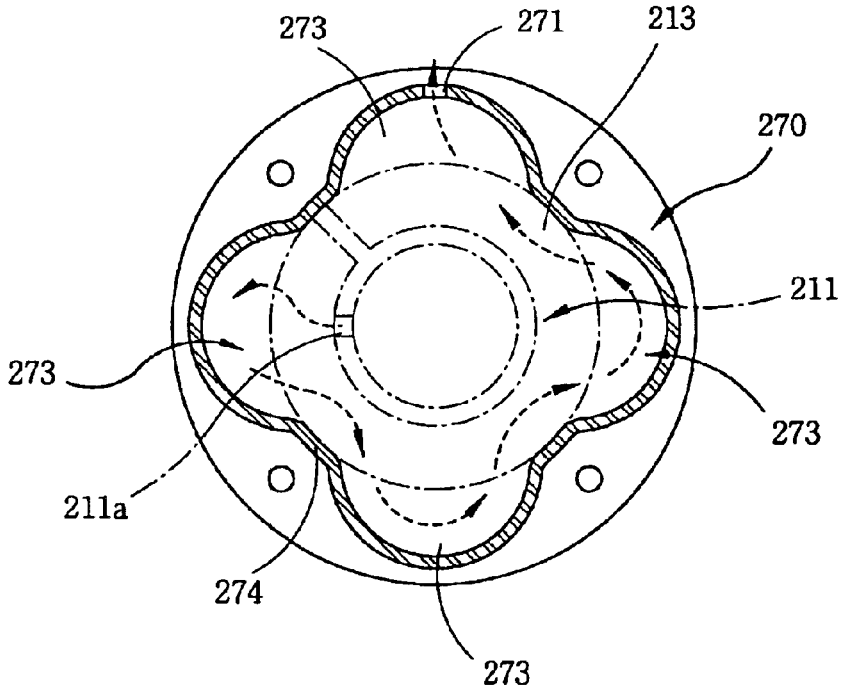
FIG. 13 is a plane view showing an operation status of a discharge apparatus of a reciprocating compressor in accordance with the present invention.

The discharged gas on the status of high pressure and temperature, as shown in FIG. 13, flows into the inner space of the discharge cover 211, and then the gas flows into the buffer space 273 of the multi-plenum cover 270 and the circumferential surface of the discharge cover 211 through the gas passage 211*a*. The gas flown to the buffer space 273 is discharged out through the discharge hole 271 passing each buffer space 273 in order by the communication passage 213.

Therefore, noise of compression pulse and valve switching generated from the process of discharging refrigerant gas is removed passing the same process as discharging gas.

Also, the principal of the Helm-Holz resonator is applied to the composition with the plurality of the buffer spaces 273 and the communication passage 213.

The invention has applicability to reciprocating compressors as are employed widely in various industrial fields. As so far described, the discharge apparatus of a reciprocating compressor is not only able to discharge compressed gas in the compression space in accordance with the rectilinear and reciprocal movement of the piston in a cylinder smoothly, but it is also able to minimize noise by removing the discharge pulse and valve switching noise of a certain bandwidth generated from inside the compressor sucking, compressing, and discharging gas thus to improve the reliability of the compressor operation.

What is claimed is:

1. A discharge apparatus of a reciprocating compressor, comprising:

a shell connected to a gas suction conduit for sucking gas;

a cylinder in the shell;

a compression unit including a piston performing reciprocal movement in the cylinder;

a reciprocating motor having an inner stator, an outer stator, and an armature performing reciprocal movement between them; and a frame unit for supporting the compression unit and the reciprocating motor by connecting them, the frame unit comprising:

a first cover member in which a valve body controlling the discharge of compressed gas by switching the cylinder is contained and at least a gas passage is formed; and a second cover member having a gas discharge hole arranged continuously with the first cover member, wherein at least a buffer space is formed between the periphery of the first cover member and an inner wall of the second cover member.

2. The apparatus according to claim 1, wherein at least a central member is additionally included between the first cover member and the second cover member at the center.

3. The apparatus according to claim 2, wherein the first cover member and the second cover member are clamped off to be combined.

4. The apparatus according to claim 3, wherein the buffer space include the a communication passage connected reciprocally.

5. The apparatus according to claim 4, wherein the buffer space makes the diameter of the inner wail in the second cover member increase or decrease in the direction of circular arc and the buffer space is formed by the inner wall in the second cover member and the outer wall in in the second cover member having a relatively small diameter than the inner wall in the second cover member and the communication passage is formed by the inner wall in the second cover member and the outer wall in the first cover member having equal diameter to the inner wall in the second cover member.

6. The apparatus according to claim 2, wherein at least a buffer space is formed either between the first cover member and the central cover member, or between the central cover member and the second cover member.

7. The apparatus according to 1, wherein the all or some part of the gas passages formed in the first cover member are formed to be connected to the above-mentioned buffer space.

8. The apparatus according to 1, wherein at least a gas passage is additionally included on the upper side of the first cover member.

9. The apparatus according to 1, wherein the buffer space is formed having equal spaces.

10. The apparatus according to claim 1, wherein four buffer spaces are formed.

11. The apparatus according to claim 1 or 9, wherein the gas passage formed in the first cover member is connected to just one of the buffer spaces to discharge gas through the buffer space in order.

12. The apparatus according to claim 1 or 2, wherein the size of the gas passage formed in the first or central cover member is less than 5 mm.

13. The apparatus according to claim 12, wherein the size of the gas passage is 2~4 mm.

14. The apparatus according to claim 1, wherein a convex unit is included in the all or some part is protruded on the upper side of the second cover member connected with the gas passage.

15. The apparatus according to claim 14, wherein the convex unit is formed in a position not to interrupt a power connector abutted to the shell.

16. A muffler for a compressor with a cylinder having a piston therein, the muffler comprising:

a first cover to receive gaseous material discharged from the cylinder, said first cover having a first outlet; and a second cover enclosing said first cover to receive the gaseous material from the outlet of said first cover, said second cover having a second outlet, wherein a buffer space between the first and second covers forms a gaseous material flow path to lose gaseous material's pressure when traveling along said flow path, the first outlet located at a beginning portion of the flow path and the second outlet located at an end portion of the flow path.

17. The muffler of claim 16, wherein the buffer space is in the form of a four-leaf clover.

18. The muffler of claim 16, wherein the buffer space is in the form of a cross.

19. A discharge apparatus of a reciprocating compressor, comprising:

a shell connected to a gas suction conduit for sucking gas;

a cylinder in the shell;

a compression unit including a piston performing reciprocal movement in the cylinder;

a reciprocating motor having an inner stator, an outer stator, and an armature performing reciprocal movement between them; and a frame unit for supporting the compression unit and the reciprocating motor by connecting them, the frame unit comprising:

a first cover member in which a valve body controlling the discharge of compressed gas by switching the cylinder is contained and at least a gas passage is formed;

a second cover member having a gas discharge hole arranged continuously with the first cover member; and a further cover member included between the first cover member and the second cover member at the center.

20. A discharge apparatus of a reciprocating compressor, comprising:

a shell connected to a gas suction conduit for sucking gas;

a cylinder in the shell;

a compression unit including a piston performing reciprocal movement in the cylinder;

a reciprocating motor having an inner stator, an outer stator, and an armature performing reciprocal movement between them; and a frame unit for supporting the compression unit and the reciprocating motor by connecting them, the frame unit comprising:

a first cover member in which a valve body controlling the discharge of compressed gas by switching the cylinder is contained and at least a gas passage is formed;

a second cover member having a gas discharge hole arranged continuously with the first cover member; and a convex unit protruded on the upper side of the second cover member connected with the gas passage.

* * * * *